US007896695B1

(12) United States Patent
Huang

(10) Patent No.: US 7,896,695 B1
(45) Date of Patent: Mar. 1, 2011

(54) COAXIAL CABLE TERMINAL

(75) Inventor: Ching-Kun Huang, Yonghe (TW)

(73) Assignee: Din Yi Industrial Co., Ltd., Taipei County (TW)

( * ) Notice: Subject to any disclaimer, the term of this patent is extended or adjusted under 35 U.S.C. 154(b) by 0 days.

(21) Appl. No.: 12/628,750

(22) Filed: Dec. 1, 2009

(51) Int. Cl.
*H01R 9/05* (2006.01)

(52) U.S. Cl. ..... 439/578

(58) Field of Classification Search ..... 439/578, 439/581, 584, 275
See application file for complete search history.

(56) References Cited

U.S. PATENT DOCUMENTS 4,180,301 A * 12/1979 Hutter ..... 439/271
4,707,040 A * 11/1987 Hansel, III ..... 439/510
4,887,979 A * 12/1989 Jacobs ..... 439/578
5,909,063 A * 6/1999 Silliman et al. ..... 307/112
6,071,144 A * 6/2000 Tang ..... 439/426
6,655,991 B2 * 12/2003 Heebe et al. ..... 439/578
6,786,757 B2 * 9/2004 Pocrass ..... 439/418
7,214,095 B1 * 5/2007 Mathews ..... 439/578
2005/0181669 A1 * 8/2005 Holland ..... 439/578
2006/0258208 A1 * 11/2006 Petersen et al. ..... 439/578
2007/0087627 A1 * 4/2007 Mathews ..... 439/578

* cited by examiner

*Primary Examiner*—Jean F Duverne
(74) *Attorney, Agent, or Firm*—Leong C. Lei

(57) ABSTRACT

A coaxial cable terminal includes an insulating shell and a connection terminal. An interior of the insulating shell is hollow and is thus formed with a holding space. Two ends of the insulating shell are provided respectively with an opening. The connection terminal is accommodated in the holding space and is extended toward one end to form at least two leaves. Each leaf is first bent inward with an abutting section and a tail end of the abutting section is then bent outward to extend with a contact section. A bonding end is formed between the abutting section and the contact section. When a coaxial cable terminal is inserted, the coaxial cable terminal is clamped by the bonding end and is bonded by elastic abutting of the abutting section. Therefore, the present invention can be compatible with the coaxial cables of various apertures and will not be elastically fatigue easily.

2 Claims, 7 Drawing Sheets

COAXIAL CABLE TERMINAL

BACKGROUND OF THE INVENTION a) Field of the Invention

The present invention relates to a connection terminal of a coaxial cable, and more particularly to a coaxial cable terminal which is compatible with all kinds of coaxial cables of various apertures.

b) Description of the Prior Art

In general, a cable TV at home normally uses a coaxial cable for signal transmission. As being provided with advantages of a large bandwidth and not being easily interfered by noise signals, the coaxial cable has been widely applied to the home TV signal transmission. In addition, also due to the aforementioned merits, a lot of vendors have chosen the coaxial cable as a transmission medium for a broadband network.

Referring to FIG. 7, it shows a three-dimensional view of a conventional coaxial cable connector. As shown in the drawing, two ends of the conventional coaxial cable connector 3 are provided respectively with an opening 31, and locations close to the openings 31 are opened respectively with a rectangular notch 32 which forms two clamping arms 33. Each clamping arm 33 includes a tilted surface 34 which is extended obliquely, and the tilted surface 34 is further extended forward with a contact surface 35.

By the aforementioned structures, a user can insert a coaxial cable terminal 36 into any opening 31 of the coaxial cable connector 3 to clamp the coaxial cable terminal 36 by the contact surfaces 35 of the clamping arms 33, thereby achieving an effect of signal transmission.

Nevertheless, when using the aforementioned coaxial cable connector 3, following problems and shortcomings actually exist to be improved.

As the rectangular notches 32 are too close to two ends of the coaxial cable connector 3, impurities such as rain or dirt will easily intrude the contact surfaces 35 of the clamping arms 33, causing oxidation to further result in bad contact. Moreover, the clamping effect is not perfect and when the coaxial cable terminal 36 of a different aperture is inserted, elastic fatigue will be formed easily.

Accordingly, how to solve the aforementioned problems and shortcomings of the prior art is a direction of research and development for improvement by the present inventor and related vendors.

SUMMARY OF THE INVENTION

The primary object of the present invention is to provide a coaxial cable terminal with higher compatibility.

To achieve the aforementioned object, the present invention includes an insulating shell and a connection terminal. An interior of the insulating shell is hollow and is thus formed with a holding space. Two ends of the insulating shell are provided respectively with an opening. The connection terminal is accommodated in the holding space and is extended toward one end to form at least two leaves. Each leaf is first bent inward with an abutting section. A tail end of the abutting section is then bent outward to extend with a contact section, and a bonding end is formed between the abutting section and the contact section.

As the connection terminal of the present invention is extended toward one end to form at least two leaves, each leaf is first bent inward to form the abutting section and the tail end of the abutting section is then bent outward to extend with the contact section, when a coaxial cable terminal is inserted from the opening at one end of the shell, the coaxial cable terminal will first touch the contact section that is bent outward. At this time, a force is then acted onto the coaxial cable terminal to extend the coaxial cable terminal into the shell, thereby accomplishing the connection of the coaxial cable terminal. On the other hand, the coaxial cable terminal can be clamped by the bonding end which can bond the coaxial cable terminal elastically through elastic abutting of the abutting section. Accordingly, the present invention can be compatible with all kinds of coaxial cable terminals of various apertures and will not be elastically fatigue easily.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
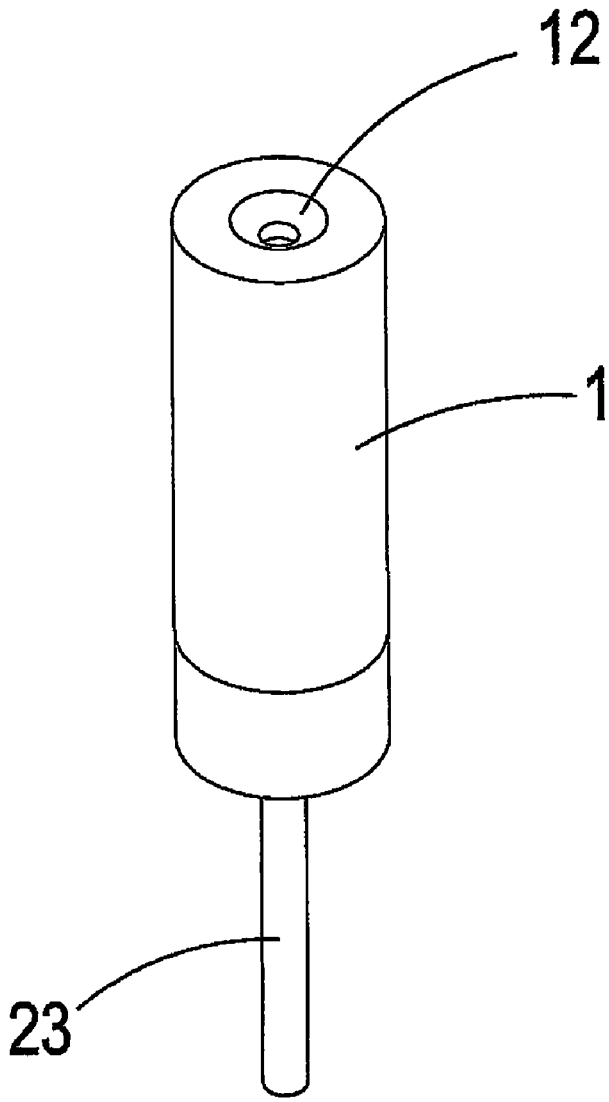
FIG. 1 shows a three-dimensional view of a preferred embodiment of the present invention.
Figure 2:
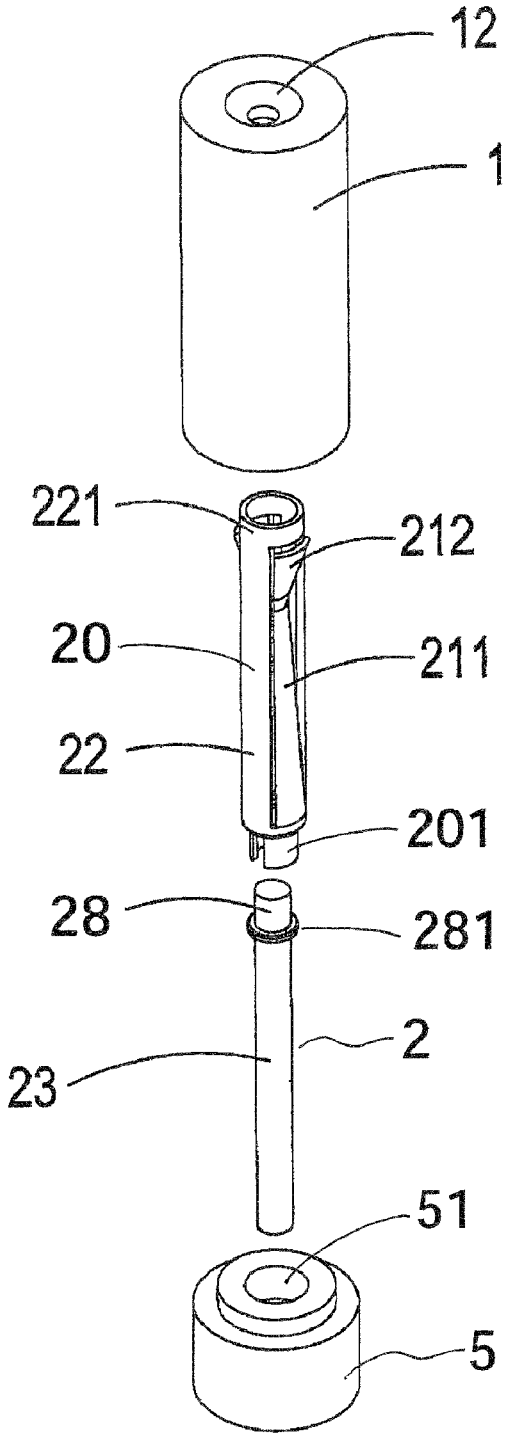
FIG. 2 shows an exploded view of the preferred embodiment of the present invention.
Figure 3:
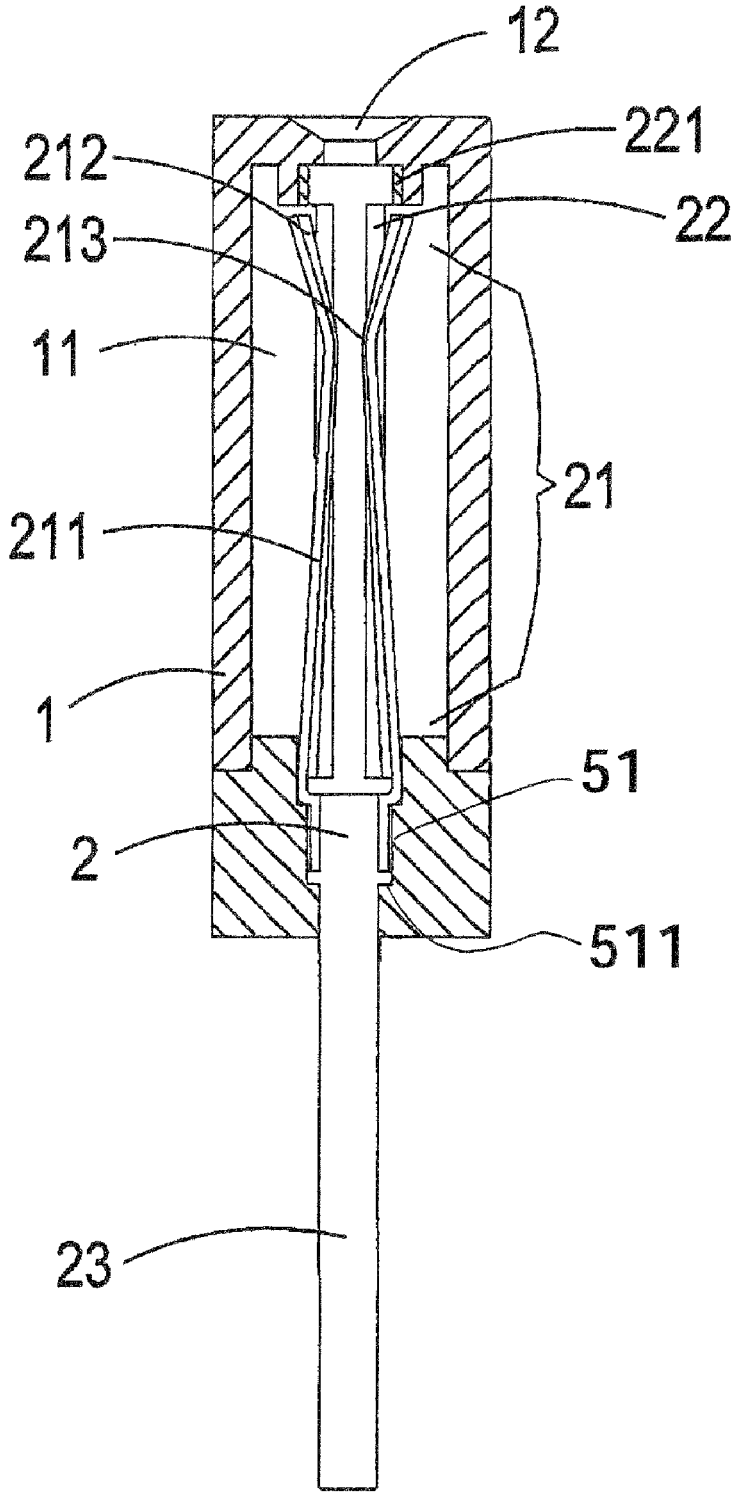
FIG. 3 shows a cutaway view of the preferred embodiment of the present invention.
Figure 4:
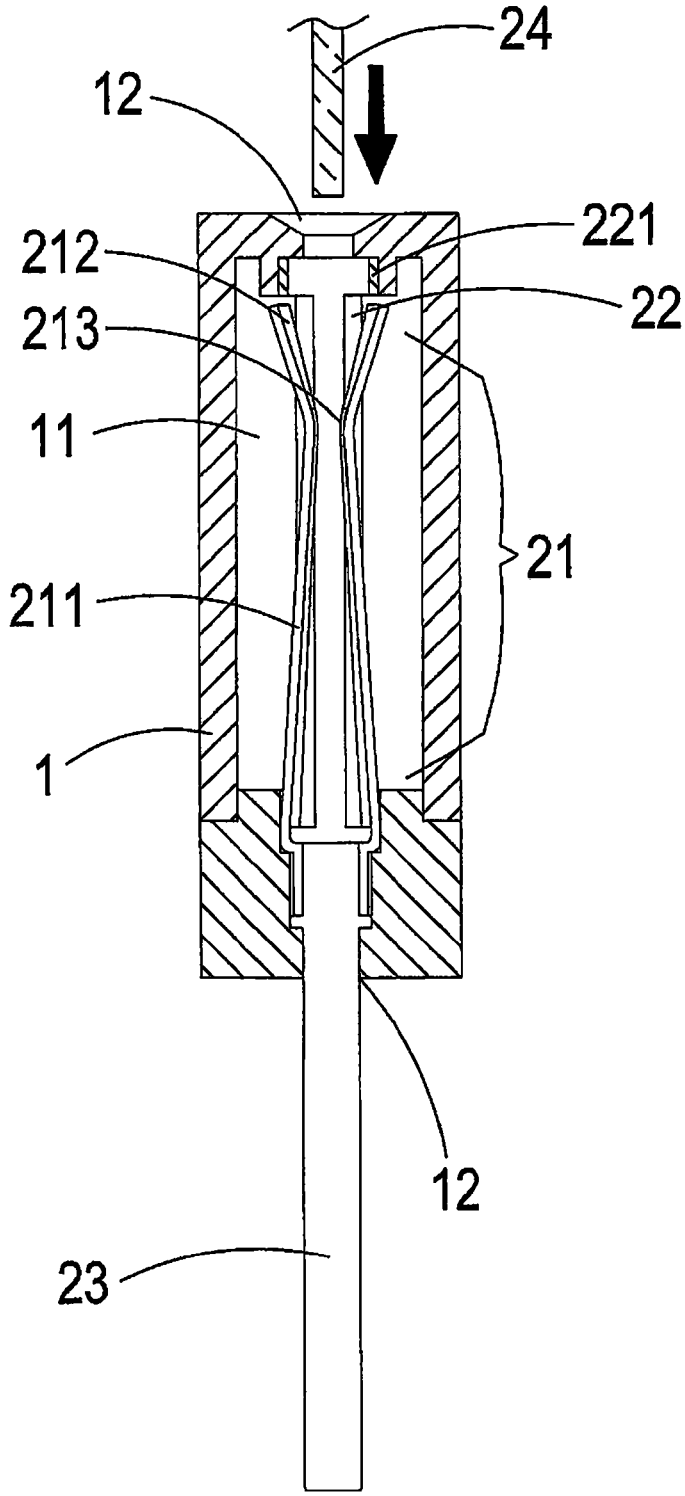
FIG. 4 shows a first schematic view of an implementation of the preferred embodiment of the present invention.
Figure 5:
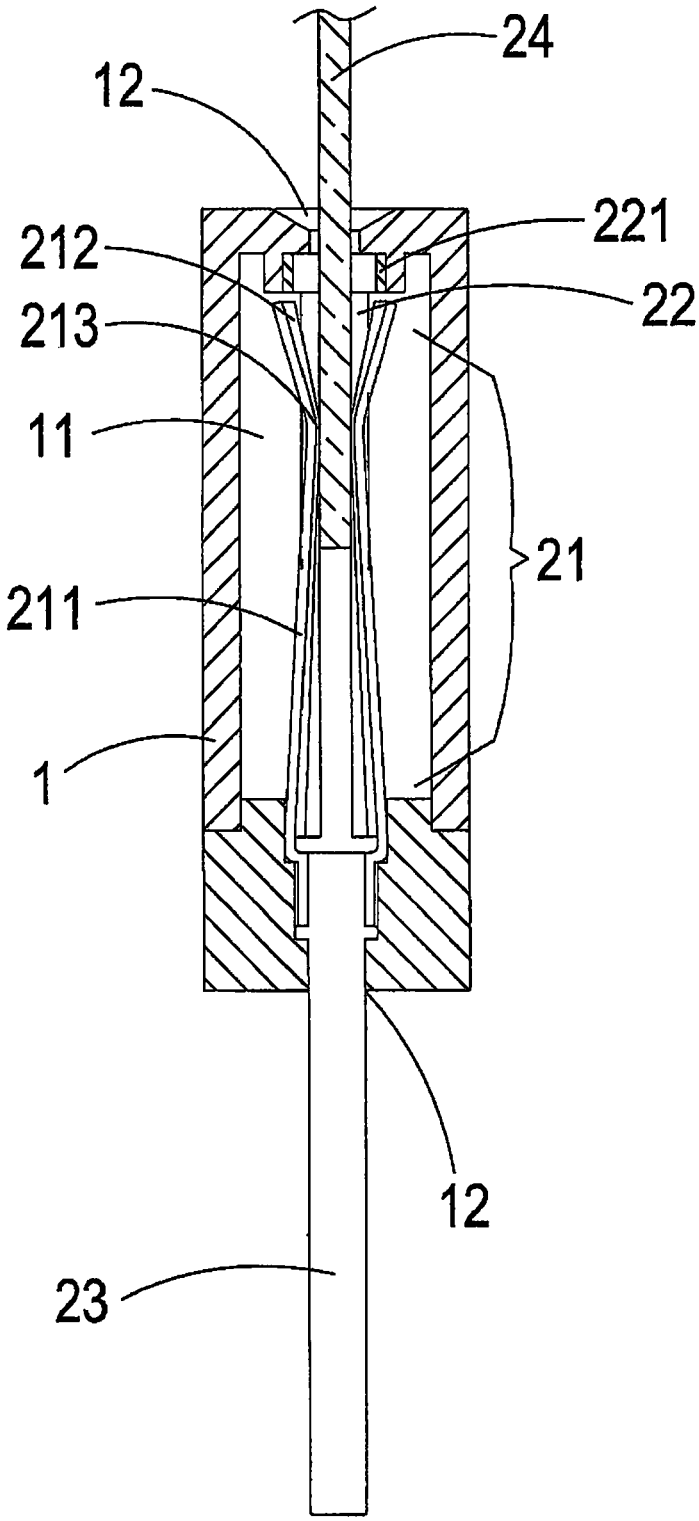
FIG. 5 shows a second schematic view of the implementation of the preferred embodiment of the present invention.

Referring to FIGS. 1, 2 and 3, it shows a three-dimensional view, an exploded view and a cutaway view, of a preferred embodiment of the present invention. As shown in the drawings, the present invention comprises an insulating shell 1, which is usually made by plastic, an interior of which is hollow and is thus formed with a holding space 11, and a connection terminal 2, which is accommodated in the holding space 11. The insulating shell 1 has an upper end provided with a hole 12 and a lower end provided with an opening. A sleeve 20 has a lower end 201 engaged with an upper end 28 of the connection terminal 2 and has at least two leaves 21, with each leaf 21 being first bent inward with an abutting section 211, a tail end of the abutting section 211 being then bent outward to extend with a contact section 212, and a bonding end 213 being formed between the abutting section 211 and the contact section 212. A base 5 is engaged with the opening of the lower end of the insulating shell 1 and has a passage 51 which has an intermediate portion provided with a shoulder 511. The connection terminal 2 has an upper end 28 and a flange 281 close to the upper end 28 of the connection terminal 2. The upper end 28 of the connection terminal 2 is inserted into the lower end 201 of the sleeve 20 with the flange 281 bearing against a bottom of the lower end 201 of the sleeve 20. The connection terminal 2 is inserted into the passage 51 of the base 5 with the flange 281 supported by the shoulder 511 of the passage 51 thereby preventing the connection terminal 2 from dropping out of the base 5.

The sleeve 20 has at least one support arm 22, a tail end of each support arm 22 forms a collar 221. The lower section of the connection terminal 2 is provided with a connection end 23 for connection.

Referring to FIGS. 3, 4, 5 and 6, it shows the cutaway view, a first schematic view of an implementation, a second schematic view of the implementation and a third schematic view of the implementation, of the preferred embodiment of the present invention. As shown in the drawings, when a coaxial cable terminal 24 is to be connected with the present invention, the coaxial cable terminal 24 is inserted into the hole 12 of the insulating shell 1, and the coaxial cable terminal 24 will first touch the contact section 212 that is bent outward. Next, a force is acted onto the coaxial cable terminal 24, and then the coaxial cable terminal 24 can be extended into the insulating shell 1 and is bonded by the bonding end 213. As a result, the connection of the coaxial cable terminal 24 is accomplished, thereby achieving a purpose of signal transmission. As the present invention includes the abutting section 211 that is bent inward, after the coaxial cable terminal 24 has been inserted into the insulating shell 1, an outer wall of the coaxial cable terminal 24 can be bonded by elastic abutting of the abutting section 211 and by the bonding end 213. Accordingly, the present invention can be effectively connected with the coaxial cable terminal 24.

Figure 6:
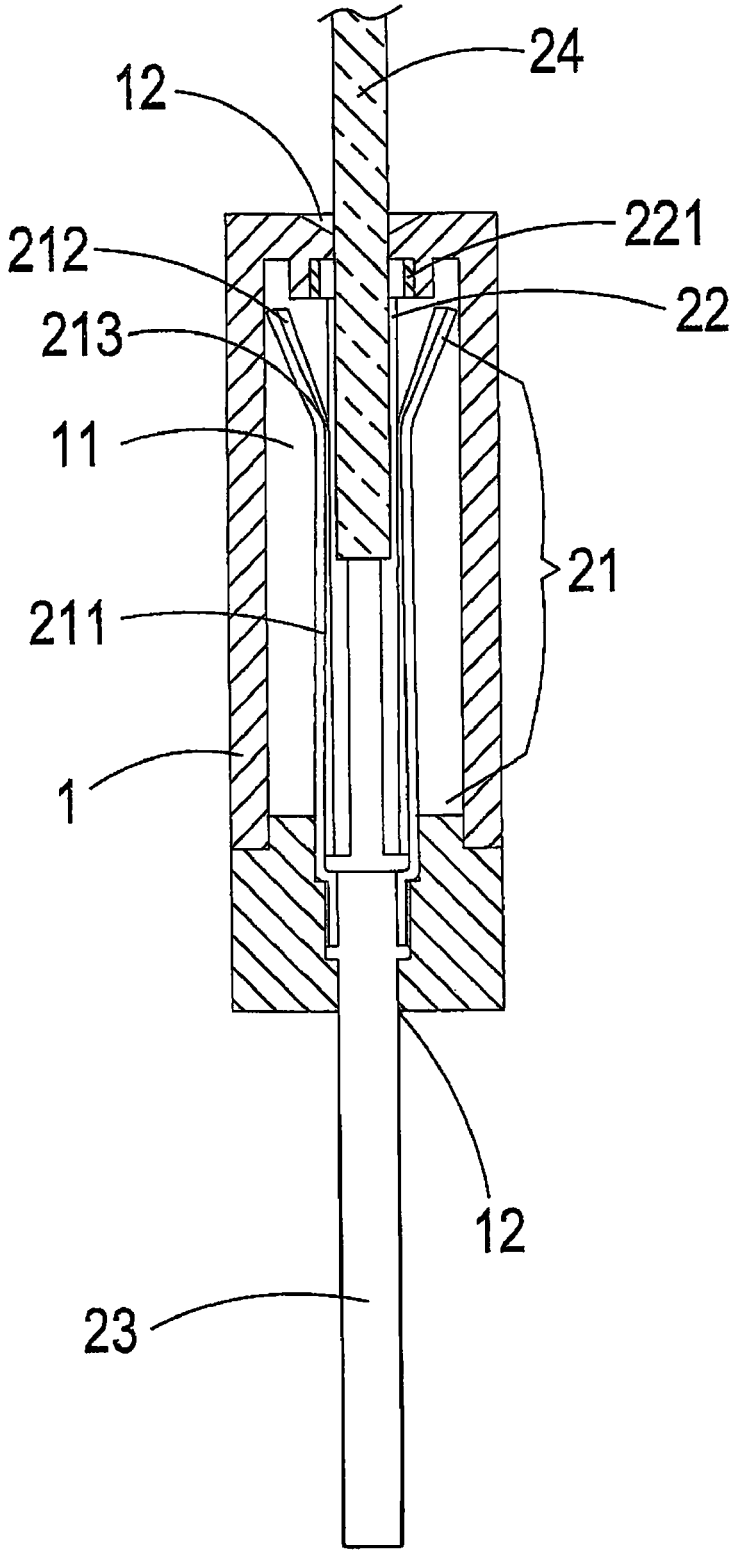
FIG. 6 shows a third schematic view of the implementation of the preferred embodiment of the present invention.
Figure 7:
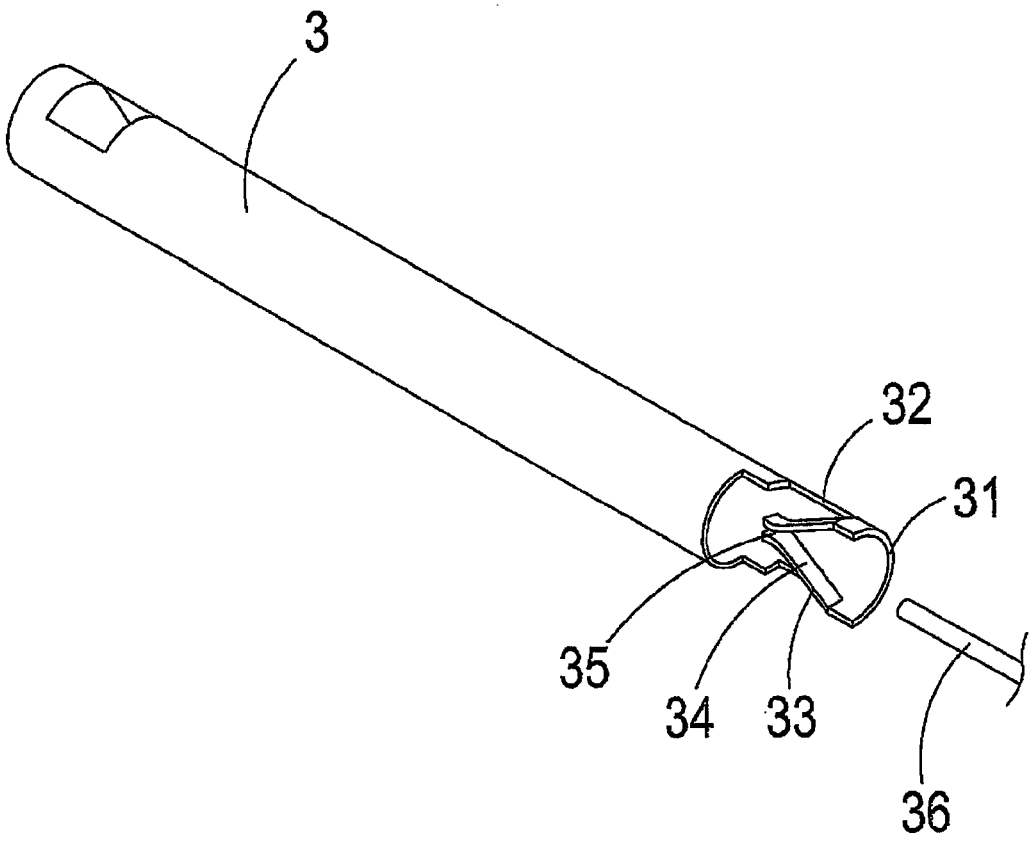
FIG.7 Prior Art
FIG. 7 shows a three-dimensional view of a conventional coaxial cable connector.

Moreover, as shown in FIG. 6, the present invention can be also compatible with the coaxial cable terminal 24 of a larger aperture. When the coaxial cable terminal 24 is inserted, the coaxial cable terminal 24 is similarly bonded by the bonding end 213. In addition, as the sleeve 20 of the present invention is bent outward to extend with the contact section 212, after the coaxial cable terminal 24 has been inserted into the insulating shell 1, the contact section 212 will touch an inner wall of the insulating shell 1 due to pushing of the coaxial cable terminal 24, allowing the contact section 212 and the abutting section 211 to be both provided with an elastic push force of bonding to the coaxial cable terminal 24, such that the coaxial cable terminal 24 can be more effectively connected. On the other hand, after the coaxial cable terminal 24 has been pulled out, the contact section 212 will restore. By the aforementioned structures, the present invention will not be elastically fatigue easily and thus is provided with a longer life time of usage.

Accordingly, referring to all the drawings, the present invention is actually provided with following advantages in comparison with the prior art.

The connection terminal 2 of the present invention is engaged with the sleeve 20 which has at least two leaves 21, each leaf 21 being first bent inward with the abutting section 211, the tail end of the abutting section 211 is then bent outward to extend with the contact section 212, and the bonding end 213 is formed between the abutting section 211 and the contact section 212. By the aforementioned structures, the present invention can be accommodated into all kinds of coaxial cable terminals 24 of various sizes and will not be elastically fatigue easily to have the longer life time of usage.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A coaxial cable terminal comprising:

an insulating shell having a hollow interior thereby forming a holding space, said insulating shell having an upper end and a lower end, said upper end having a hole, said lower end having an opening;

a base engaged with said opening of said lower end of said insulating shell and having a passage, said passage having an intermediate portion provided with a shoulder;

a sleeve fitted in said hollow interior of said insulating shell, said sleeve having at least two leaves being first bent inward with an abutting section, a tail end of said abutting section being then bent outward to extend with a contact section, and a bonding end being formed between said abutting section and said contact section, said sleeve having a lower end; and a connection terminal having an upper end and a flange close to said upper end of said connection terminal, said upper end of said connection terminal being inserted into said lower end of said sleeve with said flange bearing against a bottom of said lower end of said sleeve, said connection terminal being inserted into said passage of said base with said flange supported by said shoulder of said passage thereby preventing said connection terminal from dropping out of said base.

2. The coaxial cable terminal as claimed in claim 1, wherein said insulating shell is made of plastic.

* * * * *